US006094957A

United States Patent [19]

Masunaga et al.

[11] Patent Number: 6,094,957

[45] Date of Patent: Aug. 1, 2000

[54] METHOD FOR BENDING DIFFICULT-TO-WORK METALLIC WIRE AND METHOD FOR SHAPING COIL SECTION THEREOF

[75] Inventors: Satoru Masunaga; Kazuo Murata, both of Fukui, Japan

[73] Assignee: Masunaga Optical Mfg. Co., Ltd., Fukui, Japan

[21] Appl. No.: 09/342,905

[22] Filed: Jun. 30, 1999

[51] Int. Cl.[7] ..... B21K 29/00

[52] U.S. Cl. ..... 72/128; 72/342.4

[58] Field of Search ..... 72/342.4, 342.5, 72/342.92, 342.96, 128, 127, 135, 146, 149; 140/71.5

[56] References Cited

U.S. PATENT DOCUMENTS

| | | | |
|---|---|---|---|
| 2,281,132 | 4/1942 | Young | 72/342.96 |
| 4,175,228 | 11/1979 | Bizzari et al. | 72/342.96 |
| 5,186,036 | 2/1993 | Kamada | 72/342.92 |

FOREIGN PATENT DOCUMENTS

| | | | |
|---|---|---|---|
| 58-192625 | 11/1983 | Japan . | |
| 61-165244 | 7/1986 | Japan . | |
| 16530 | of 1908 | United Kingdom | 140/71.5 |

*Primary Examiner*—Rodney Butler
*Attorney, Agent, or Firm*—Finnegan, Henderson, Farabow, Garrett & Dunner, L.L.P.

[57] ABSTRACT

A method is provided for bending a difficult-to-work metallic wire into a complicated profile. A predetermined length of the difficult-to-work metallic wire is prepared. Part of a portion thereof is held by a conductive clamping device. A first conductive pressure member is brought into contact with a first bending work position of the workpiece, while applying a predetermined pressing force thereto, electric power is supplied between the first member and the clamping device via the wire. Thereby, the wire is bent by a predetermined amount, which part of the wire thus bent by the predetermined amount is located on a conductive rod having a circular cross-section. A second conductive pressure member is brought into contact with a second bending work position of the wire, while applying a constant pressing force to the second member, electric power is supplied between the second member and the conductive rod via the wire. In this state, the relative displacement is caused between the second member and the conductive rod in the bending direction.

19 Claims, 12 Drawing Sheets

METHOD FOR BENDING DIFFICULT-TO-WORK METALLIC WIRE AND METHOD FOR SHAPING COIL SECTION THEREOF

This application is based on Patent Application No. 10-109704 (1998) filed Apr. 20, 1998 in Japan, the content of which is incorporated hereinto by reference.

BACKGROUND OF THE INVENTION

1. Field of the Invention

The present invention relates to a method for bending material which exhibits a large spring back at a normal temperature and is liable to harden during the machining and be easily crackable, such as a difficult-to-work metallic wire, particularly to a method for bending such a difficult-to-work metallic wire as titanium alloy including Ni—Ti type alloy having a shape-memory effect, hyper elastic characteristic or others. More specifically, the present invention relates to a method for shaping a coil section of a difficult-to-work metallic wire suitable for constituting an antenna for a mobile phone having a bend of small radius of curvature in a coil form.

2. Description of Related Art

Demand for small-size portable type telecommunication devices have recently increased and functions thereof have increasingly been improved. Together therewith, the minimization of an outer dimension of such a device has also been required, which is accompanied with the requirement for the improvement in function of antenna used therefor and for the minimization of its size. Also, since such an antenna is withdrawn from a body of the telecommunication device and maintained in an extended state upon use, it is necessary for the antenna not to easily bend during withdrawal and not to be broken even though it is brought into contact with an outer object in the extended state.

For satisfying the requirement for the minimization of a size of antenna while maintaining the resistance to flexing and the resistance to breakage at a desired level, it has been contemplated to constitute the antenna from a difficult-to-work metallic wire, for example, of titanium alloy including Ni—Ti alloy having a shape-memory effect, hyper elastic characteristic or others and to shape a coil section in this antenna.

In the prior art, the bending work of the difficult-to-work metallic wire is generally carried out by a so-called hot working wherein the wire is preliminarily heated as a whole to a predetermined temperature by the radiation heating using a heater, the high frequency induction heating or the resistance heating, and then is deformed in a die of a press.

This prior art bending method, however, has problems in that it is time-consuming and requires an odd space or a heat-resistant installation because the wire must be heated as a whole by either of the above-mentioned heating methods and/or a large amount of heat is irradiated to the environment surrounding the same as well as a precise and, therefore, expensive temperature sensor is necessary for the temperature control of the wire.

Also, among the above-mentioned heating methods, the resistance heating is capable of heating the wire alone in a shorter time with less influence on the environment because it is an internal heating utilizing the electric resistance of the wire itself. According to this heating method, however, it is difficult to evenly heat the wire in its entirety and to bend the wire into a complicated profile. Thus, this heating method is restricted to a bending process for obtaining a relatively simple profile.

In other words, there has heretofore been no technology suitable for bending the wire into a complicated profile such as a coil form as described above.

SUMMARY OF THE INVENTION

An object of the present invention is to solve such problems in the prior art as described above by providing a method for bending a difficult-to-work metallic wire to obtain a complicated profile.

Another object of the present invention is to provide a method for shaping a difficult-to-work metallic wire into a complicated profile, particularly into a coil form.

To achieve the above objects, in the first aspect of the present invention, there is provided a method for bending a difficult-to-work metallic wire, comprising the steps of:

- fixedly placing the difficult-to-work metallic wire on a conductive support member having a surface of a predetermined bending curvature;
- bringing a conductive pressure member into contact with a portion of the difficult-to-work metallic wire to be bent; and
- supplying electric power between the conductive pressure member and the conductive support member through the difficult-to-work metallic wire while applying a constant pressing force to the conductive pressure member until the difficult-to-work metallic wire has been deformed to have the predetermined bending curvature.

In the second aspect of the present invention, there is provided a method for bending a difficult-to-work metallic wire, comprising the steps of:

- fixedly placing the difficult-to-work metallic wire on a conductive support member having a surface of a predetermined bending curvature;
- bringing a conductive pressure member into contact with a portion of the difficult-to-work metallic wire to be bent;
- supplying electric power between the conductive pressure member and the conductive support member through the difficult-to-work metallic wire while applying a constant pressing force to the conductive pressure member; and
- causing the relative displacement between the conductive pressure member and the conductive support member in the bending direction of the difficult-to-work metallic wire.

In the third aspect of the present invention, there is provided a method for shaping a coil section of a difficult-to-work metallic wire, comprising the steps of:

- preparing the difficult-to-work metallic wire of a predetermined length;
- holding a portion of the difficult-to-work metallic wire where no work is to be carried out, by a conductive clamping device;
- bringing a first conductive pressure member into contact with a first bending work position of the difficult-to-work metallic wire;
- supplying electric power between the first conductive pressure member and the conductive clamping device via the difficult-to-work metallic wire while applying a predetermined pressing force to the first conductive pressure member, until the difficult-to-work metallic wire has been bent by a predetermined amount;
- locating part of the portion of the difficult-to-work metallic wire which has been bent by the predetermined amount on a conductive rod having a circular cross-section;

bringing a second conductive pressure member into contact with a second bending work position of the difficult-to-work metallic wire;

supplying electric power between the second conductive pressure member and the conductive rod via the difficult-to-work metallic wire while applying a constant pressing force to the second conductive pressure member; and causing the relative displacement between the second conductive pressure member and the conductive rod in the bending direction of the difficult-to-work metallic wire.

Here, the conductive support member having the surface of the predetermined bending curvature may be a rod of a circular cross-section, and the relative displacement may be caused by displacing the rod in the axial direction thereof while rotating the rod at a predetermined speed.

The difficult-to-work metallic wire may be of Ni—Ti type alloy.

The above and other objects, effects, features and advantages of the present invention will become more apparent from the following description of embodiments thereof taken in conjunction with the accompanying drawings.

DETAILED DESCRIPTION OF PREFERRED EMBODIMENTS

As one embodiment of a method for bending a difficult-to work metallic wire according to the present invention, the shaping of a coil section in an antenna for a mobile phone will be described with reference to the attached drawings.

Figure 15:
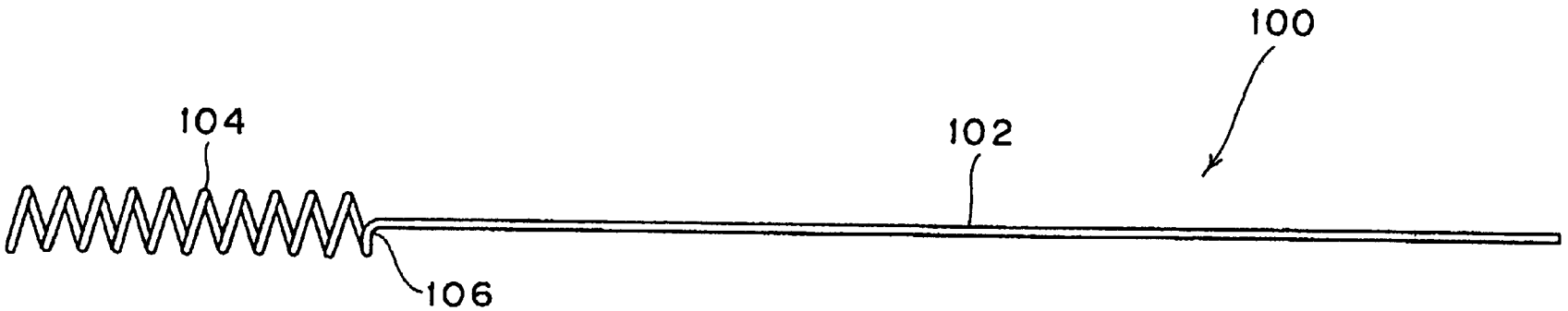
FIG. 15 is a side view of an antenna for a mobile phone as one example to which the method according to the present invention is applied.

First, an antenna for a mobile phone to be shaped will be roughly described based on FIG. 15 for facilitating the reader's understanding of the invention.

In FIG. 15, reference numeral 100 denotes an antenna as a whole; 102 a linear section; and 104 a coil section. In general, it is required that the antenna 100 for a mobile phone has a length equal to one quarter of wavelength used for the telecommunication. While it is possible to construct an antenna in a linear form as a whole provided this requirement is satisfied, it is better to provide the coil section 104 called as a loading coil for the purpose of shortening a total length of the antenna to realize a small-size telephone. In this regard, needless to say, a coil diameter, the number of windings, a coil pitch or others must be selected so that predetermined electric properties necessary for the antenna are obtainable.

Figure 1:
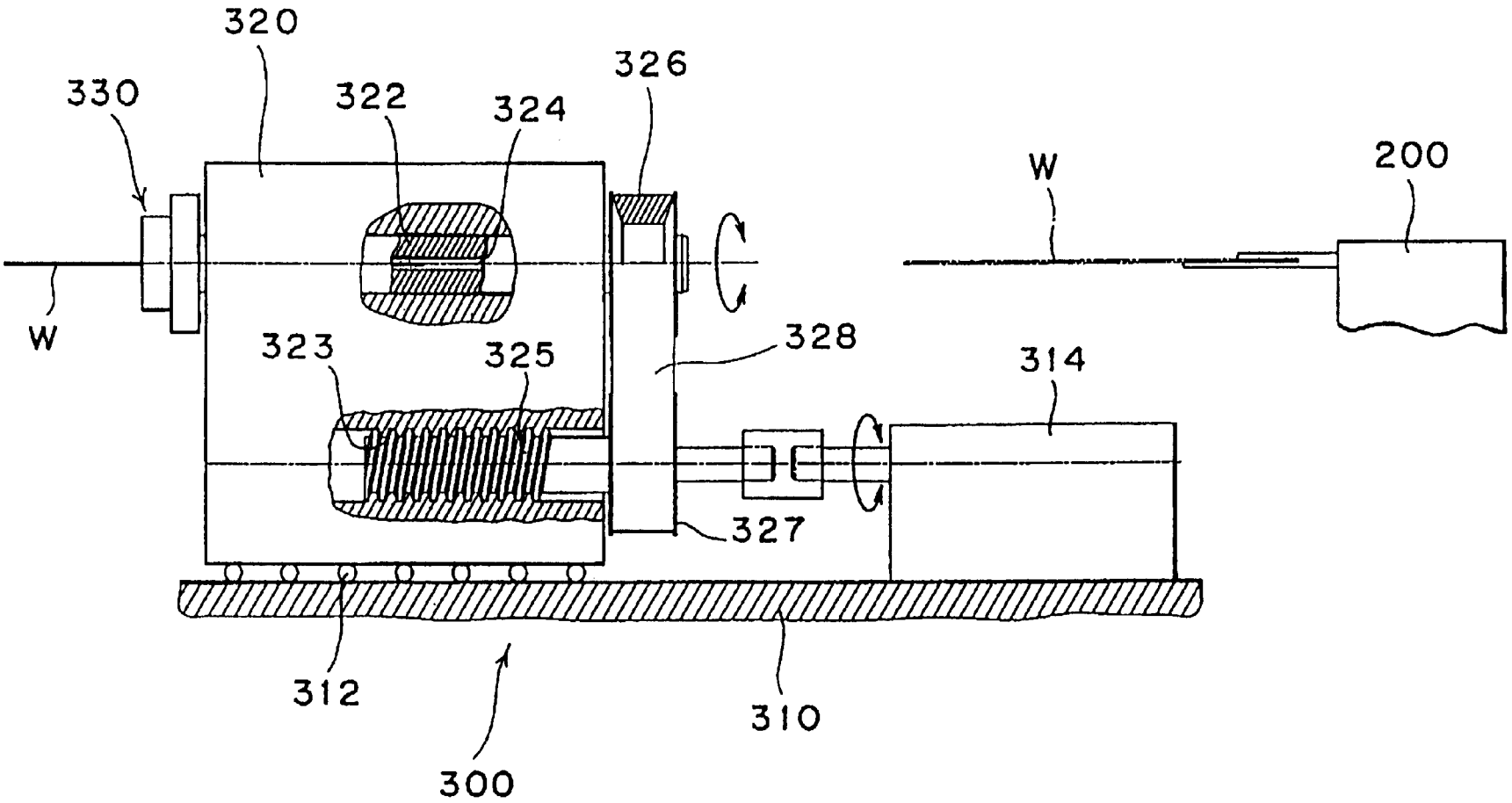
FIG. 1 is a partially broken side view of one embodiment of a working machine for carrying out the method according to the present invention.
Figure 2:
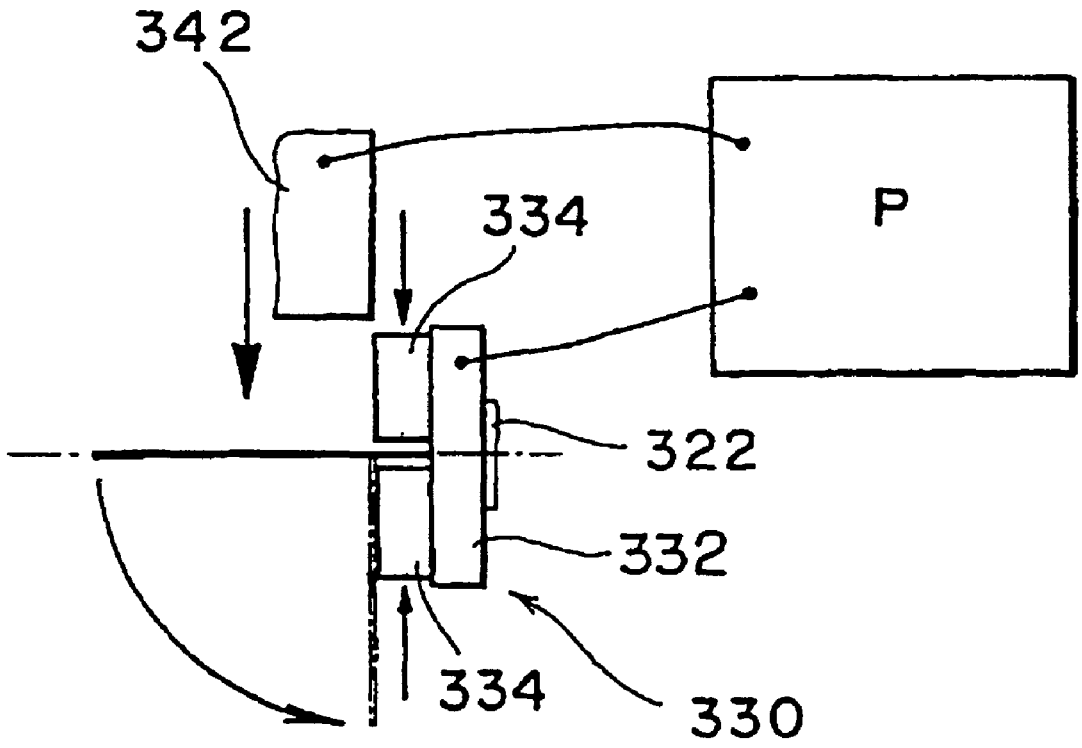
FIG. 2 is a plan view of part of the working machine shown in FIG. 1.
Figure 3A:
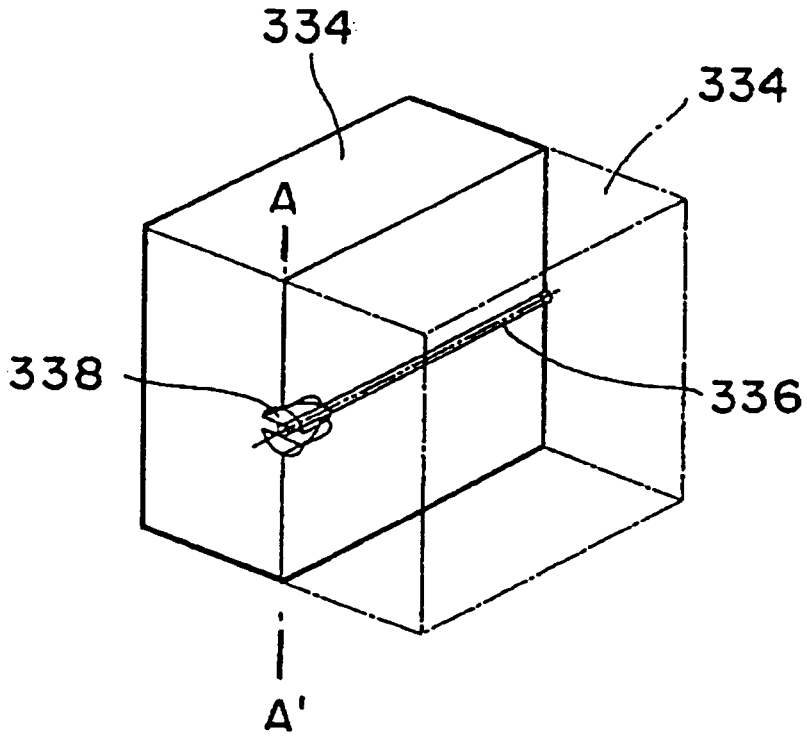
FIGS. 3A and 3B illustrate a clamping device and chucking pieces of the working machine shown in FIG. 1 wherein 3A is a perspective view and 3B is a partially enlarged view thereof.
Figure 3B:
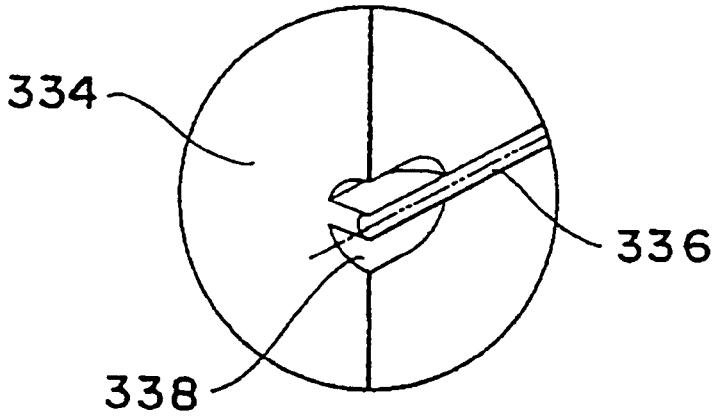
Figure 4:
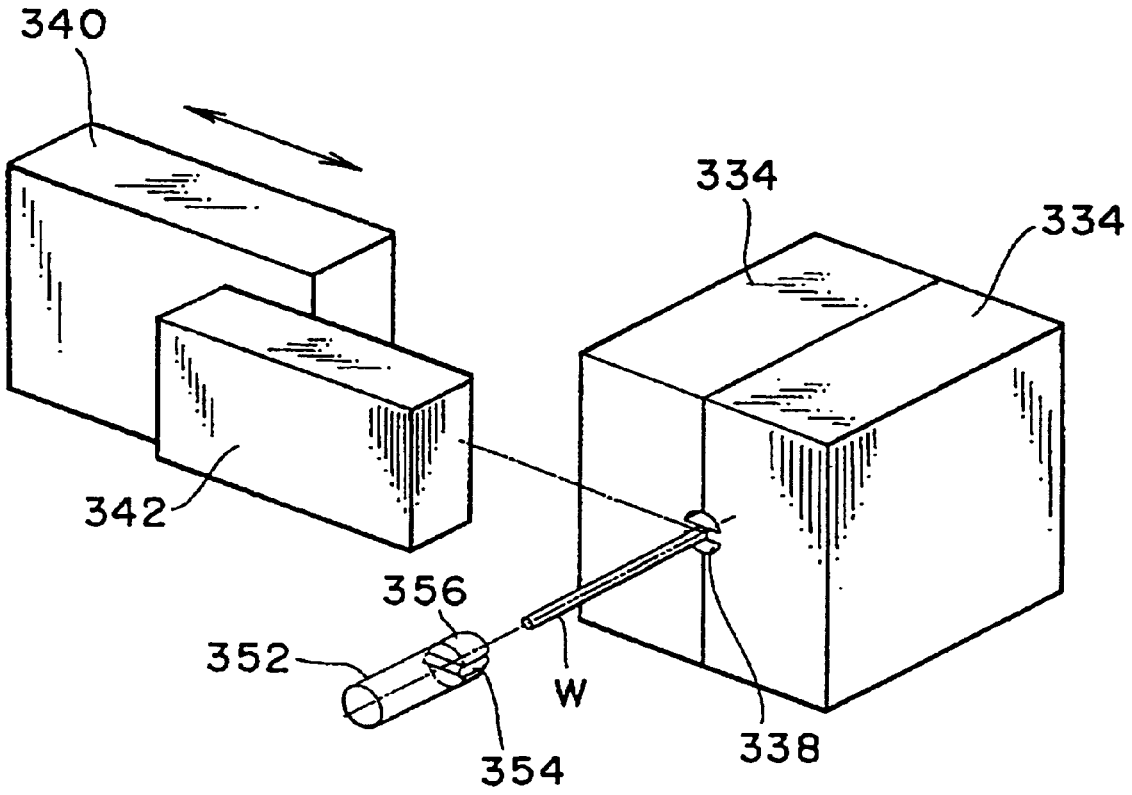
FIG. 4 is a perspective view illustrating a workpiece W held by the chucking pieces of the clamping device in the working machine.
Figure 5:
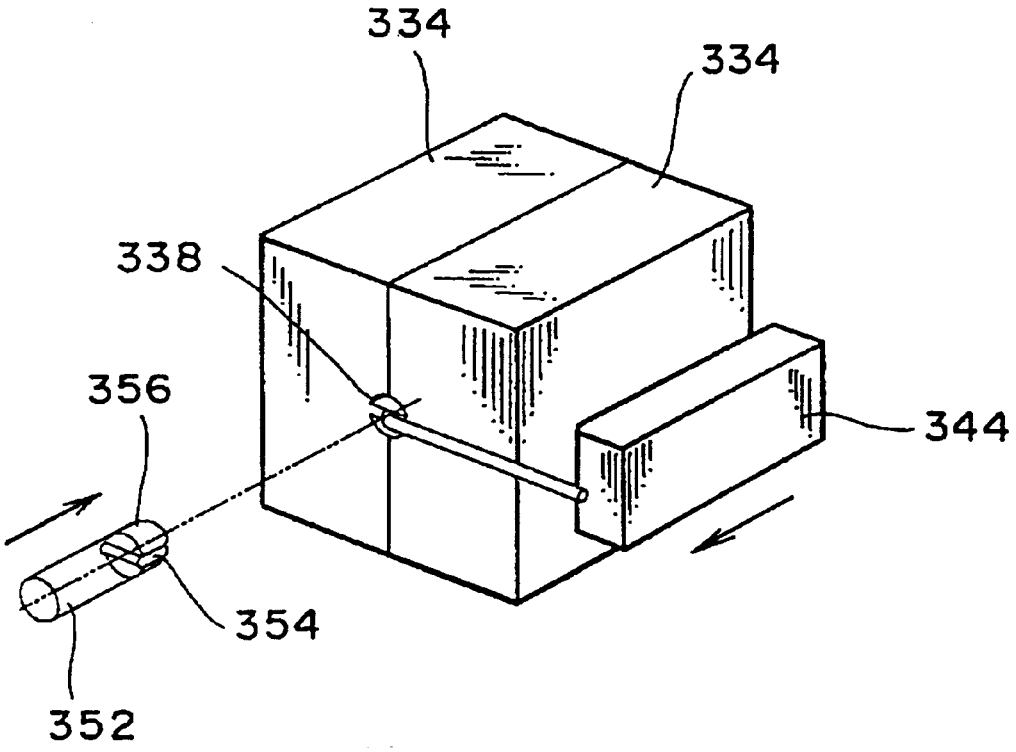
FIG. 5 is a perspective view illustrating a bending state of the workpiece W in a first bending work position.

Next, a rough description will be made on a working machine for carrying out the bending work according to the present invention. With reference to FIG. 1, a feeder 200 holds one end of a workpiece W and feeds the same to a working machine 300.

The working machine 300 is provided with a main body 320 supported to be movable on a base 310 by rollers 312 and a motor 314 stationarily fixed onto the base 310. The main body 320 has a conductive clamping device 330 adapted to be rotatable relative to the main body, and in turn, the clamping device 330 is attached, in this embodiment, to one end of a hollow shaft 322 which is supported by the main body 320 to be rotatable. A guide hole 324 is formed along a center axis of the shaft 322, through which a workpiece W in a wire form is insertable. At the other end of the shaft 322, a timing pulley 326 is attached. On the other hand, a guide thread 323 is formed in the main body 320 in parallel to the axis of the shaft 322 and engaged with a lead screw 325. The lead screw 325 is drivably coupled to the above-mentioned motor 314 and has a timing pulley 327. The timing pulleys 326 and 327 are made to rotate by a timing belt 328 in a synchronous manner.

Next, the clamping device 330 will be described with reference to FIGS. 2 to 6. The clamping device 330 is provided with a flange 332 attached to one end of the shaft 322 and a pair of chucking pieces 334, 334 openable left/rightward relative to the flange 332. Each of the chucking pieces 334 has on the extension of the guide hole 324 a guide groove 336 of a semicircular cross-section engageable with the workpiece W in a wire form, and at the outer end, has a pair of engagement grooves 338 located on upper and lower sides of the guide groove 336 and engageable with a bifurcated section of a guide rod described later.

On the lateral side of the clamping device 330, a linear sliding device 340 is arranged to drive a first conductive pressure member 342 leftward and rightward. The first conductive pressure member 342 and the flange 332 as well as the chucking pieces 334 are connected to a power source P for supplying electric power. Also, on the lateral side of the chucking piece 334 disposed opposite to the linear sliding device 340, a pressure member 344 is arranged to be extendable from the end surface of the chucking piece 334 (see FIGS. 5 and 6).

Figure 7:
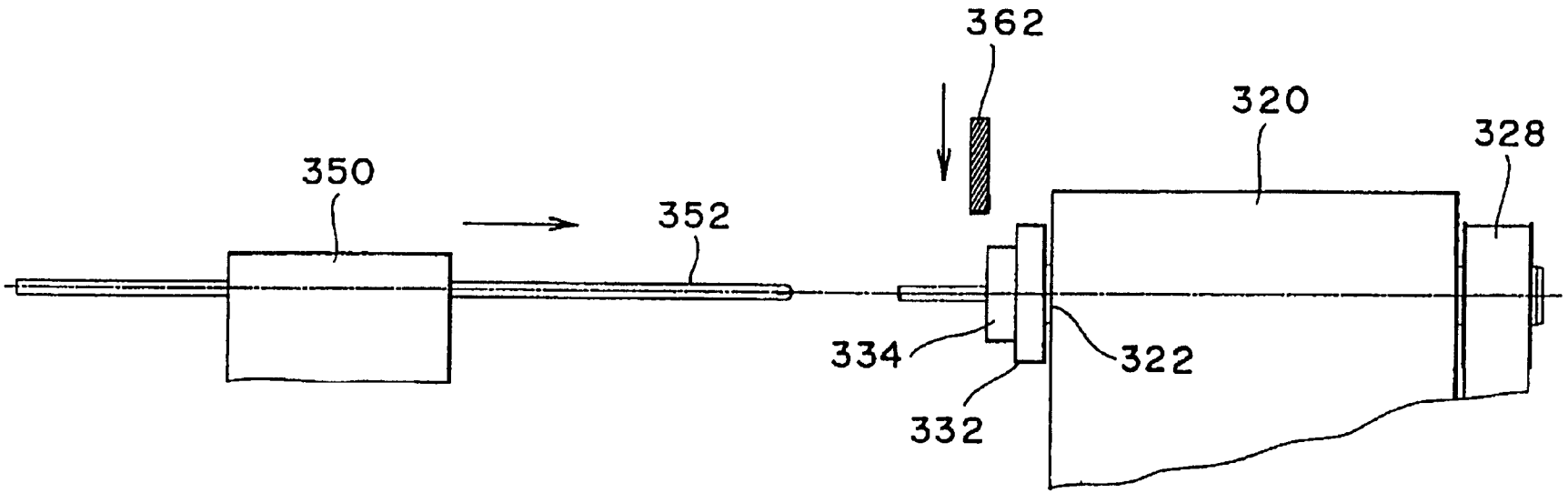
FIG. 7 is a side view illustrating the relationship between a main body of the working machine for carrying out the method according to the present invention and a guide-rod sliding device.
Figure 8:
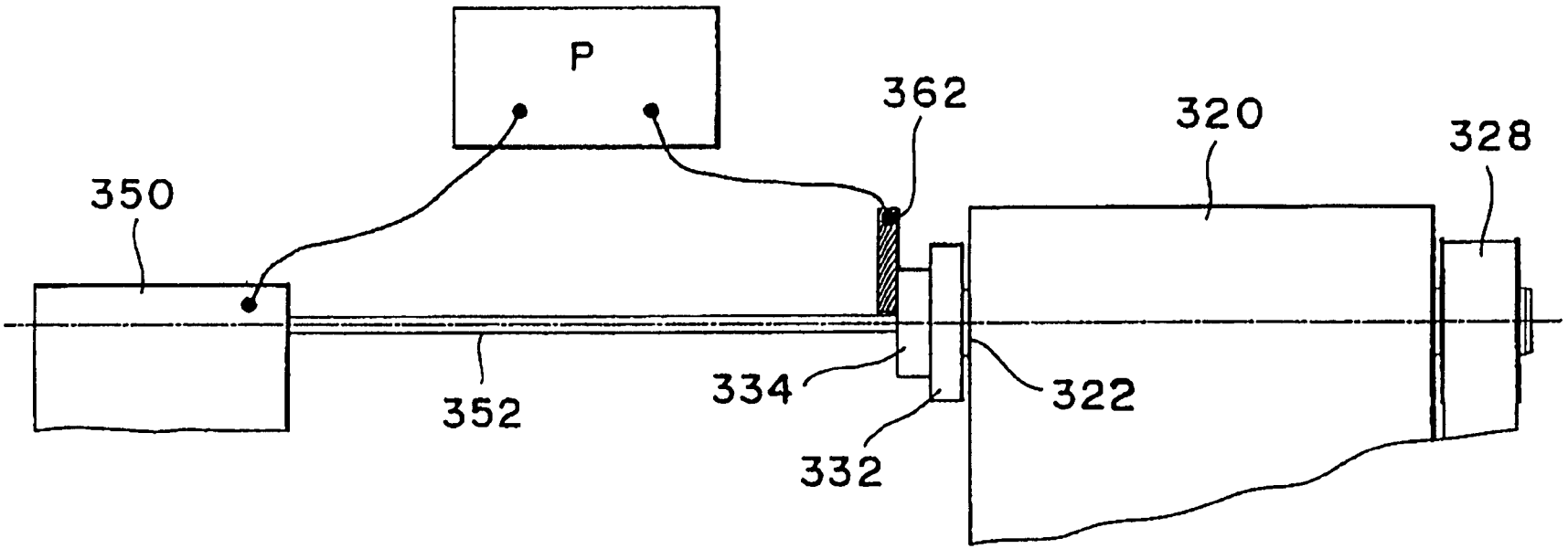
FIG. 8 is a side view illustrating the engagement of a guide rod of the working machine for carrying out the method according to the present invention with the chucking pieces, and the relationship between them and a second conductive pressure member.

Referring further to FIGS. 7 and 8, a guide-rod sliding device 350 is provided on the base 310 while being opposed to the main body 320, for sliding a guide rod 352 used as a conductive supporting member or a conductive rod member on the extension line of the guide hole 324 of the shaft 322 described before. The guide rod 352 has at a tip end thereof a bifurcated section 356 divided by a U-shaped groove 354 as described before (see FIGS. 4 and 5). In this regard, a width of the U-shaped groove 354 is generally equal to a diameter of the workpiece W in a wire form to be shaped, and a diameter of the guide rod 352 is generally equal to an inner diameter of the coil section 104. Any material may be used for the guide rod 352 provided that it is hard and conductive to a certain extent; such as die steel, high speed tool steel or others.

Figure 9:
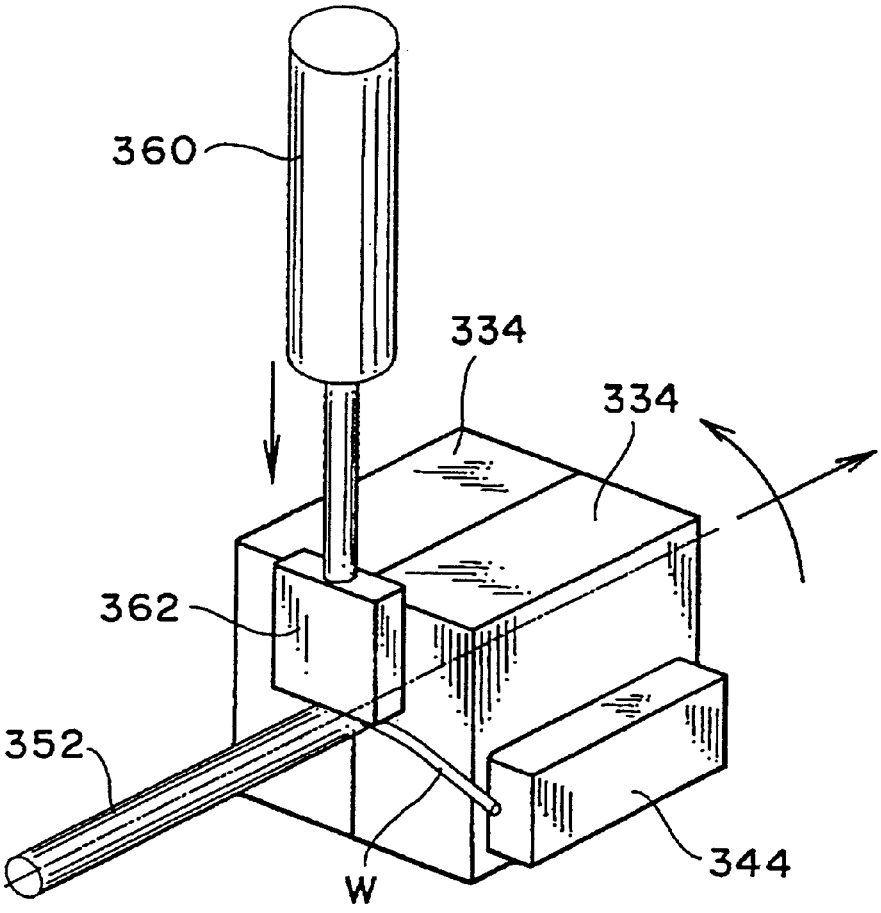
FIG. 9 is a perspective view illustrating the relationship between the second conductive pressure member and the workpiece W in a state shown in FIG. 8.
Figure 10:
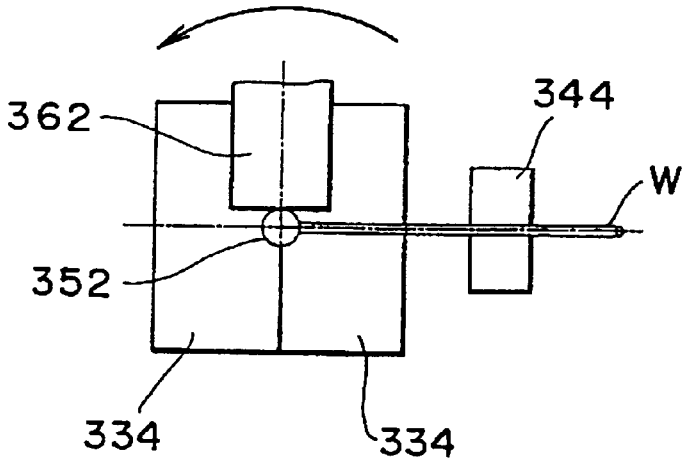
FIG. 10 is a front view illustrating the relationship between the second conductive pressure member and the workpiece W in the state shown in FIG. 8.
Figure 11:
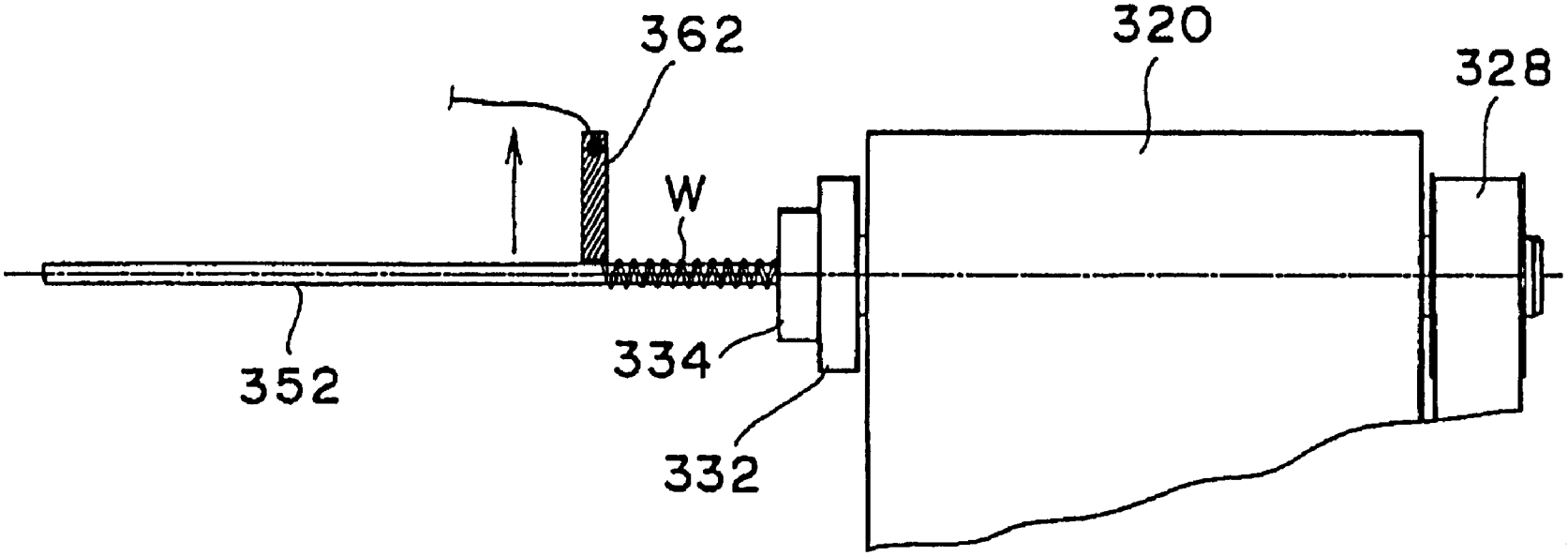
FIG. 11 is a side view illustrating the shaping of coil by the working machine for carrying out the method according to the present invention.
Figure 12:
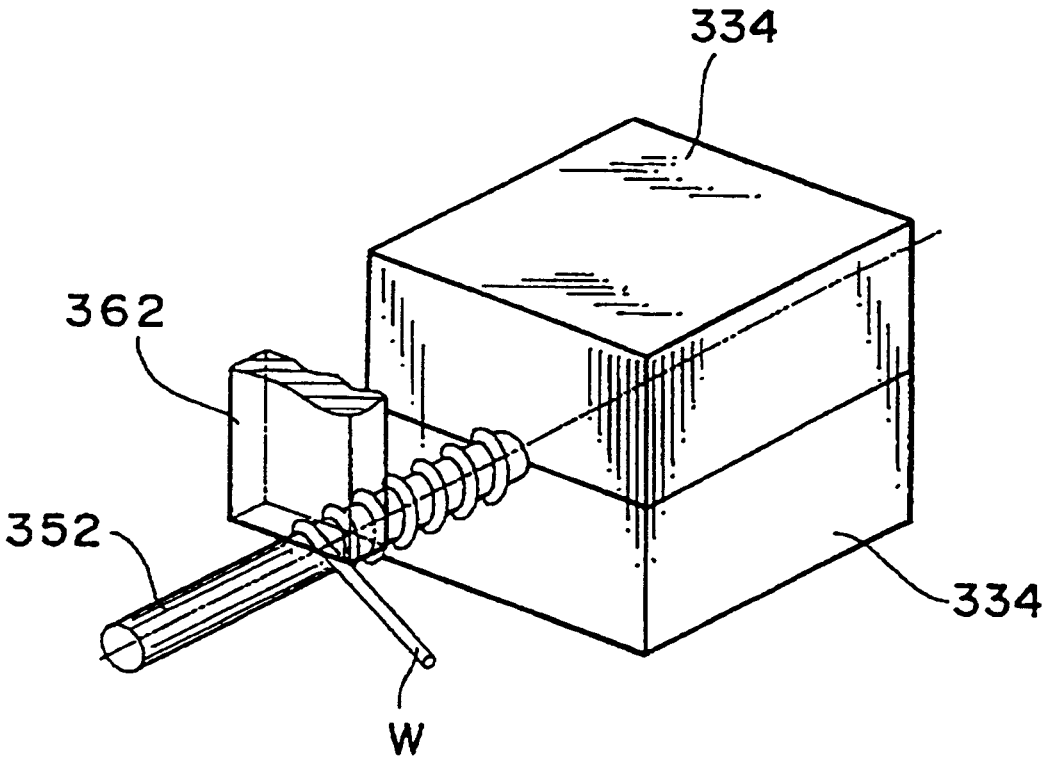
FIG. 12 is a perspective view illustrating the shaping of coil by the working machine for carrying out the method according to the present invention.
Figure 13:
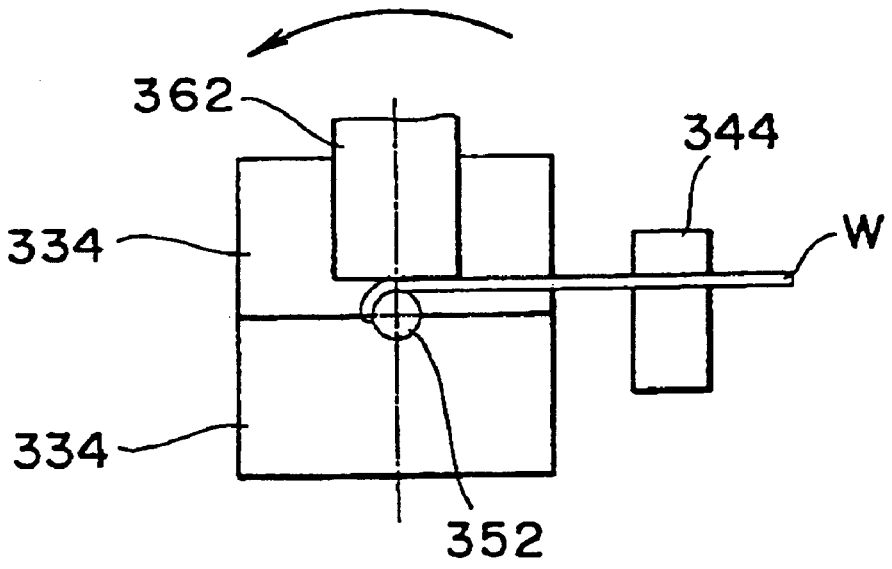
FIG. 13 is a front view illustrating the shaping of coil by the working machine for carrying out the method according to the present invention.

For example, as shown in FIG. 9, a pneumatic cylinder device 360 is arranged approximately above the clamping device 330, for moving a second conductive pressure member 362 upward and downward so that a predetermined constant pressing force is applied to the second conductive pressure member 362 during the bending operation. And, the conductive pressure member 362 and the guide-rod sliding device 350 as well as the guide rod 352 are connected to the power source P so that electric power is supplied therefrom. Materials used for forming the second conductive pressure member 362 are heat-resistant, abrasion-resistant and preferably have a suitable hardness and electro-conductivity, such as copper-tungsten or silver-tungsten. In this regard, alternatively to the pneumatic cylinder, a spring or the like may be used for pressing the second conductive pressure member 362 at a constant pressure.

Next, the bending operation for obtaining the antenna 10 for a mobile phone shown in FIG. 15 by using the working machine 300 described above will be explained in the order of the steps thereof.

First, the workpiece W in a wire form of Ni—Ti type alloy which is cut into a predetermined length by a cutter not shown is held at one end by the feeder 200. The workpiece W is inserted into the guide hole 324 of the shaft 322 in the working machine 300 by the feeder 200 until a tip end of the workpiece W projects out of the end surface of the chucking piece 334 by a distance corresponding to a length of the coil section 104, at which position the workpiece W is released from being held. In this state, the clamping device 300 starts the operation by a command from a controller not shown, whereby the pair of chucking pieces 334 are closed to hold the workpiece W in the guide grooves 336 thereof (see FIGS. 1 to 3).

Then, the linear sliding device 340 starts the operation by a command from the controller not shown to bring the first conductive pressure member 342 into contact with the first bending work position of the workpiece W. While applying a predetermined force onto the first bending work position of the workpiece W, the electric power is supplied between the first conductive pressure member 342 and the conductive clamping device 330 from the power source P via the workpiece W. According to this supply of electric power, electric current flows transverse to the wire at the first bending work position of the workpiece W whereby that portion of the wire is heated due to the electric resistance at a predetermined rate of temperature rise. Upon reaching a certain temperature, the bending deformation commences. The supply of electric power is interrupted when the bending deformation reaches a predetermined amount. Then, the workpiece W is cooled by the chucking pieces 334, and the deformation thereof is instantaneously stopped. In this embodiment, the workpiece W is bent approximately at a right angle at the first bending work position (indicated as 106 in FIG. 15), by which it has been confirmed that the wire of Ni—Ti type alloy of 0.7 mm diameter could be bent to have a radius of curvature of approximately 0.5 mm.

Figure 6:
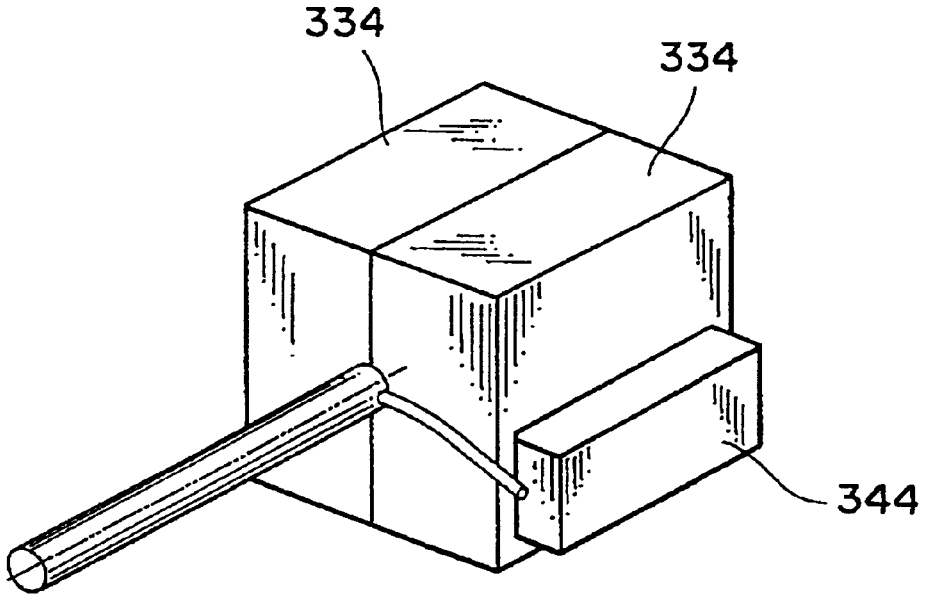
FIG. 6 is a perspective view illustrating the elastic deformation of a portion of the workpiece to be bent.

Next, while maintaining the workpiece W in this state wherein it is bent at a right angle at the first bending work position (see FIG. 5), the guide-rod sliding device 35 starts the operation by a command from the controller not shown to engage the bifurcated section 356 provided at a tip end of the guide rod 352 with the pair of engagement grooves 338. Then, as shown in FIG. 6, the bending portion of the workpiece W projects out of the U-shaped groove 354 of the guide rod 352 so that a configuration is obtained wherein part thereof is located on the guide rod 352. At that time, the pressure member 344 starts the operation to elastically deform the bending portion of the workpiece W away from the end surface of the chucking piece 334 in a curved manner.

Thereupon, the pneumatic cylinder device 360 starts the operation by a command from the controller not shown to descend the second conductive pressure member 362 to be brought into contact with a second bending work position of the workpiece W. While applying a constant pressing force to the second conductive pressure member 362, electric power is supplied between the second conductive pressure member 362 and the guide rod 352 via the workpiece W. Simultaneously therewith, the motor 314 starts the operation to rotate the lead screw 325. According to this supply of electric power, electric current flows transverse to the wire at the second bending work position of the workpiece W in the same manner as in the first bending work position described above, whereby that portion of the wire is heated at a predetermined rate of temperature rise. Upon reaching a certain temperature (for example, in a range from 200 to 300° C.), the bending deformation commences by the application of a constant pressing force and finishes when the predetermined amount of deformation is reached. Since the lead screw 325 is rotating at the second bending work position due to the operation of the motor 314, as stated above, the second conductive pressure member 362 and the guide rod 352 move relatively to each other in the bending direction of the workpiece W, whereby the heating position described above sequentially displaces to a non-heated portion of the workpiece W, and the bending operation; i.e., the formation of coil section is continuously carried out.

More specifically, when the lead screw 325 rotates, the main body 320 moves backward in accordance with the pitch and the rotational speed of the screw 325. Simultaneously therewith, the shaft 322, the clamping device 330 and the guide rod 352 which are associated with each other by the timing belt 328 via the timing pulleys 326, 327 are made to rotate at the same speed as the lead screw 325 together with the workpiece W. Accordingly, the pitch and the rotational speed of the lead screw 325 are preferably selected in correspondence to the pitch of the coil section 104 in the workpiece W.

Figure 14:
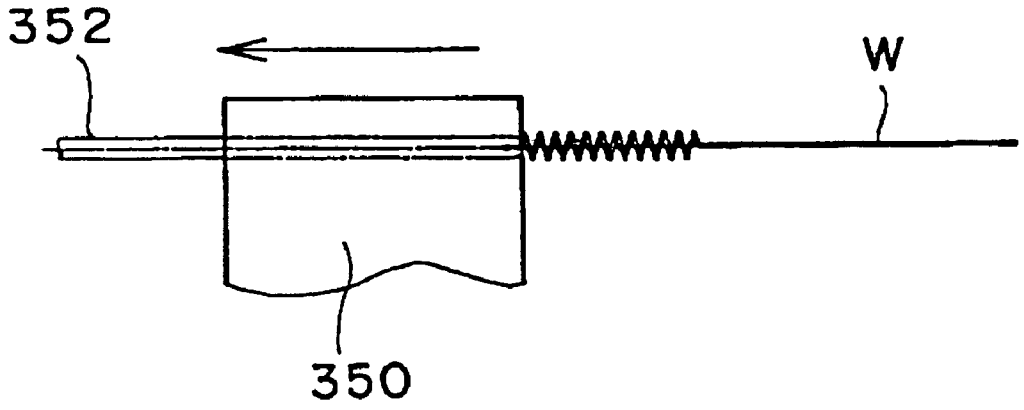
FIG. 14 is a side view illustrating the completion of the shaping of coil by the working machine for carrying out the method according to the present invention.

When the shaping of the coil section 104 has been completed, the supply of electric power is interrupted and the motor 314 is made to stop. Then, as shown in FIG. 14, the guide-rod sliding device 350 starts the operation to withdraw the guide rod 352 from the coil section 104.

Although the present invention has been described with reference to the embodiment wherein the antenna is manufactured by bending a wire of Ni—Ti type alloy, it is needless to say that the present invention should not be limited thereto. For example, the present invention is applicable to the bending work of other difficult-to-work material such as other types of titanium alloy. Further, it is also applicable not only to the formation of antenna but also to that of a frame, a temple and a bridge of eyeglasses or others.

According to the present invention, since the heating is restricted to a portion of the workpiece to be bent, there is less thermal influence on other portion unnecessary for heating, compared to the prior art method wherein the workpiece must be heated as a whole for the purpose of bending operation.

Also, even when a shape-memory alloy of Ni—Ti type is used, there is less change in characteristic of the material since the heating is restricted to a local area for a shorter period. Further, there is no recovery to the original shape due to the heating.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method for shaping a coil section of a metallic wire, comprising the steps of:

preparing the metallic wire of a predetermined length;

holding a portion of the metallic wire where no work is to be carried out, by a conductive clamping device;

bringing a first conductive pressure member into contact with a first bending work position of the metallic wire;

connecting an electric power source to the first conductive pressure member and the conductive clamping device to thereby supply current through the metallic wire while applying a predetermined pressing force to the first conductive pressure member, to bend the metallic wire by a predetermined amount;

locating part of the portion of the metallic wire which has been bent by the predetermined amount on a conductive rod having a circular cross-section;

bringing a second conductive pressure member into contact with a second bending work position of the metallic wire;

connecting an electric power source to the second conductive pressure member and the conductive rod to thereby supply current through the metallic wire while applying a pressing force to the second conductive pressure member; and causing a relative displacement between the second conductive pressure member and the conductive rod in the bending direction of the metallic wire.

2. A method as claimed in claim 1, wherein the relative displacement is caused by displacing the clamping device and the rod in the axial direction thereof while rotating them at a predetermined speed.

3. A method as claimed in claim 1, wherein the metallic wire is of Ni—Ti type alloy.

4. The method of one of claim 1, wherein the wire is a difficult-to-work metallic wire.

5. The method of one of claim 1, wherein applying the pressing force includes applying a constant pressing force.

6. The method of one of claim 1, wherein supplying the current through the wire includes supplying the current at least in part in a transverse direction through the wire.

7. A method as claimed in claim 2, wherein the metallic wire is of Ni—Ti type alloy.

8. A method for bending a metallic wire, comprising the steps of:

fixedly placing the metallic wire on a conductive support member having a surface of a predetermined bending curvature;

bringing a conductive pressure member into contact with a portion of the metallic wire to be bent; and connecting an electric power source to the conductive pressure member and the conductive support member to thereby supply current through the metallic wire while applying a pressing force to the conductive pressure member to deform the metallic wire to the predetermined bending curvature.

9. A method as claimed in claim 1, wherein the metallic wire is of Ni—Ti type alloy.

10. The method of one of claim 1, wherein the wire is a difficult-to-work metallic wire.

11. The method of one of claim 1, wherein applying the pressing force includes applying a constant pressing force.

12. The method of one of claim 1, wherein supplying the current through the wire includes supplying the current at least in part in a transverse direction through the wire.

13. A method for bending metallic wire, comprising the steps of:

fixedly placing the metallic wire on a conductive support member having a surface of a predetermined bending curvature;

bringing a conductive pressure member into contact with a portion of the metallic wire to be bent;

connecting an electric power source to the conductive pressure member and the conductive support member to thereby supply current through the metallic wire while applying a pressing force to the conductive pressure member; and causing a relative displacement between the conductive pressure member and the conductive support member in a bending direction of the metallic wire.

14. A method as claimed in claim 13, wherein the conductive support member having the surface of the predetermined bending curvature is a rod of a circular cross-section, and the relative displacement is caused by displacing the rod in the axial direction thereof while rotating the rod at a predetermined speed.

15. The method of one of claim 13, wherein the wire is a difficult-to-work metallic wire.

16. The method of one of claim 13, wherein applying the pressing force includes applying a constant pressing force.

17. The method of one of claim 13, wherein supplying the current through the wire includes supplying the current at least in part in a transverse direction through the wire.

18. A method as claimed in claim 13, wherein the metallic wire is of Ni—Ti type alloy.

19. A method as claimed in claim 14, wherein the metallic wire is of Ni—Ti type alloy.

* * * * *

UNITED STATES PATENT AND TRADEMARK OFFICE

CERTIFICATE OF CORRECTION

PATENT NO. : 6,094,957
DATED : August 1, 2000
INVENTOR(S) : Satour Masunaga et al.

It is certified that error appears in the above-identified patent and that said Letters Patent is hereby corrected as shown below:

Column 8, claim 9,
Line 22, "claim 1" should read -- claim 8 --.

Column 8, claim 10,
Line 25, "claim 1" should read -- claim 8 --.

Column 8, claim 11,
Line 27, "claim 1" should read -- claim 8 --.

Column 8, claim 12,
Line 29, "claim 1" should read -- claim 8 --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*